US005665532A

United States Patent [19]

Peters et al.

[11] Patent Number: 5,665,532

[45] Date of Patent: Sep. 9, 1997

[54] BLACK AND WHITE PAPER WITH VARIABLE GRADATION

[75] Inventors: Manfred Peters, Leverkusen; Thomas Kaluschke, Leichlingen; Hans Öhlschläger; Bruno Mücke, both of Bergisch Gladbach, all of Germany

[73] Assignee: Agfa-Gevaert AG, Germany

[21] Appl. No.: 681,270

[22] Filed: Jul. 22, 1996

[30] Foreign Application Priority Data

Jul. 31, 1995 [DE] Germany ..... 19 528 057.1
Jan. 15, 1996 [DE] Germany ..... 19 601 141.8

[51] Int. Cl.[6] ..... G03C 1/16; G03C 1/18; G03C 1/29

[52] U.S. Cl. ..... 430/571; 430/572; 430/576; 430/588; 430/595

[58] Field of Search ..... 430/572, 576, 430/585, 587, 570, 595, 588, 571

[56] References Cited

U.S. PATENT DOCUMENTS

| | | | |
|---|---|---|---|
| 3,933,507 | 1/1976 | Von Konig et al. | 430/595 |
| 4,724,200 | 2/1988 | Maskasky | 430/567 |
| 4,987,063 | 9/1991 | Kampfer et al. | 430/550 |
| 5,091,298 | 2/1992 | Parton et al. | 430/595 |

FOREIGN PATENT DOCUMENTS

| | | | |
|---|---|---|---|
| 58/107533 | 6/1983 | Japan . | |
| 542905 | 2/1942 | United Kingdom | 430/595 |
| 1 420 060 | 6/1972 | United Kingdom . | |
| 1 343 719 | 1/1974 | United Kingdom . | |

*Primary Examiner*—Lee C. Wright
*Attorney, Agent, or Firm*—Connolly & Hutz

[57] ABSTRACT

A black & white paper with variable gradation containing a silver chloride-bromide emulsion, which is divided into at least three portions, one of which is sensitised with a blue sensitiser and two further portions are sensitised both with differing quantities of blue sensitiser and with differing quantities of a green sensitiser, wherein the blue sensitiser is of the formula (I) and the green sensitiser is of the formula (II)

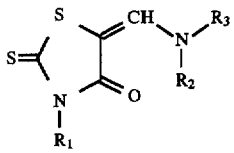

(I)

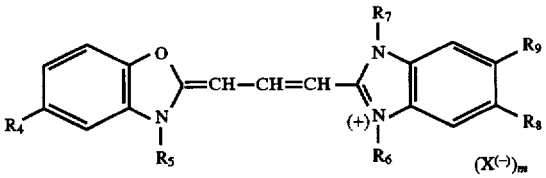

(II)

in which $R_1$ to $R_8$, $X^{(-)}$ and m have the meaning stated in the specification, is distinguished by an extended gradation range.

4 Claims, No Drawings

BLACK AND WHITE PAPER WITH VARIABLE GRADATION

This invention relates to a black and white paper (B&W paper) with variable gradation having a silver halide emulsion which is sensitised to the green and blue region of the spectrum, wherein a wider copying range is obtained on exposure in the green region than in the blue region. The material is characterised by an extended gradation range with steep initial gradation.

Photosensitive silver halide materials with variable gradation contain emulsions or emulsion constituents which are photosensitive to different regions of the spectrum. Harder (steeper) or sorer (flatter) gradation is obtained depending upon the composition of the copying light. These materials are usually blue and green sensitised layered materials. On exposure with blue light, hard gradation is obtained and on exposure with pure green light, soft gradation is obtained. Corresponding intermediate gradations are obtained on mixed exposure.

B&W papers with variable gradation are known, for example from DE 37 39 783.

Hitherto known B&W papers with variable gradation still have an inadequate gradation range.

The object of the invention was to provide a B&W paper with variable gradation which has an extended gradation range, wherein the gradation curves should have a profile which is as far as possible a straight line.

This object is achieved with the material described below.

The present invention thus provides a black & white paper with variable gradation containing a silver chloride-bromide emulsion, which is divided into at least three portions, one of which is sensitised with a blue sensitiser and two further portions are sensitised both with differing quantities of blue sensitiser and with differing quantities of a green sensitiser, characterised in that the blue sensitiser is of the formula (I) and the green sensitiser is of the formula (II)

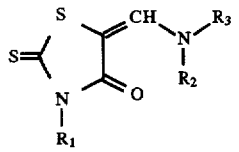

(I)

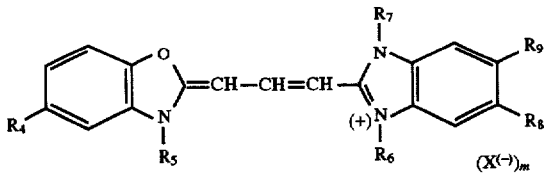

(II)

in which $R_1$ means alkyl, alkenyl, aryl or aralkyl, $R_2$ and $R_3$ mutually independently mean hydrogen, alkyl, alkenyl or aryl or together mean the remaining members of a 5 to 7 membered ring, $R_4$ means hydrogen, halogen, alkyl, alkoxy or aryl, $R_5$ and $R_6$ mutually independently mean alkyl, carboxyalkyl or sulphoalkyl, means alkyl, hydroxyalkyl or acyloxyalkyl, $R_7$ means halogen, CN or $CF_3$, $R_8$ means hydrogen, halogen or $CF_3$ $X^{(-)}$ means an anion and m means 0 or 1, wherein m means 0 if at least one of residues $R_5$ and $R_6$ means sulphoalkyl.

$R_1$ is preferably $C_1$–$C_6$ alkyl which is unsubstituted or substituted by carboxy, halogen, hydroxy or $C_1$–$C_4$ alkoxycarbonyl, $C_2$–$C_6$ alkenyl, phenyl or benzyl which are unsubstituted or substituted by halogen, $C_1$–$C_4$ alkyl or $C_1$–$C_4$ alkoxy.

$R_2$ is preferably hydrogen or $C_1$–$C_4$ alkyl.

$R_3$ is preferably $C_1$–$C_4$ alkyl which is unsubstituted or substituted by hydroxy, phenyl which is unsubstituted or substituted by halogen, $C_1$–$C_4$ alkyl or $C_1$–$C_4$ alkoxy, or $C_2$–$C_6$ alkenyl.

Furthermore, $R_2$ and $R_3$ may, together with the nitrogen atom, form a saturated 5 to 7 membered ring, optionally containing a further heteroatom such as N, O or S.

$R_4$ is preferably hydrogen, halogen, $C_1$–$C_4$ alkyl or phenyl.

$R_5$ and $R_6$ are preferably $C_1$–$C_6$ alkyl residues which are unsubstituted or substituted by OH, $SO_3H$, COOH or $SO_2NHCOC_1$–$C_4$-alkyl.

$R_7$ is preferably $C_1$–$C_4$ alkyl which is unsubstituted or substituted by OH.

The dyes of the formulae (I) and (II) are known.

Examples of dyes of the formula (I) are:

| | $R_1$ | $R_2$ | $R_3$ |
|---|---|---|---|
| I-1 | $C_2H_5$ | H | 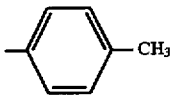 |
| I-2 | $CH_2COOC_2H_5$ | H | 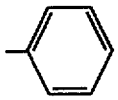 |
| I-3 | $CH_2CH{=}CH_2$ | $CH_3$ | 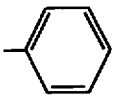 |
| I-4 | $CH_2COOH$ | | $(CH_2)_2-N(CH_3)-(CH_2)_2$ |
| I-5 | $C_2H_5$ | | $(CH_2)_4$ |
| I-6 | $CH_2COOH$ | | $(CH_2)_2O(CH_2)_2$ |
| I-7 | $C_2H_5$ | H | 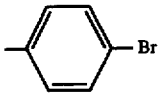 |
| I-8 | $CH_3$ | $C_4H_9$ | $C_4H_9$ |
| I-9 | $CH_2CF_2CHF_2$ | H | 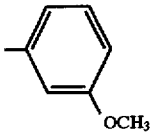 |
| I-10 | $C_2H_5$ | | $(CH_2)_5$ |
| I-11 | $C_2H_5$ | | $(CH_2)_2O(CH_2)_2$ |
| I-12 | $C_3H_7$ | H | $CH_2CH{=}CH_2$ |
| I-13 | $CH_2CH_2OH$ | $CH_3$ | $CH_3$ |
| I-14 | $C_2H_5$ | $CH_3$ | $CH_2CH_2OH$ |
| I-15 | 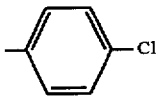 | $CH_3$ | $CH_3$ |

Examples of dyes of the formula (II) are:

| | $R_4$ | $R_5$ | $R_6$ | $R_7$ | $R_8$ | $R_9$ | X |
|---|---|---|---|---|---|---|---|
| II-1 | Cl | $(CH_2)_3SO_3^-$ | $C_2H_5$ | $C_2H_5$ | CN | H | |
| II-2 | Cl | $C_2H_5$ | $(CH_2)_3SO_3^-$ | $CH_3$ | Cl | H | |
| II-3 | Cl | $CH_3$ | $(CH_2)_4SO_3^-$ | $C_2H_5$ | Cl | Cl | |
| II-4 | 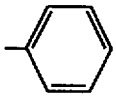 | $C_2H_5$ | $(CH_2)_4SO_3^-$ | $C_2H_5$ | $CF_3$ | H | |
| II-5 | 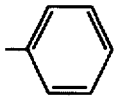 | $C_2H_5$ | $(CH_2)_2CH(SO_3^-)-CH_3$ | $C_2H_5$ | $CF_3$ | H | |
| II-6 | Cl | $(CH_2)COOH$ | $C_2H_5$ | $C_2H_5$ | Cl | Cl | $I^\ominus$ |
| II-7 | 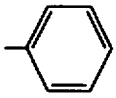 | $(CH_2)COOH$ | $(CH_2)_3SO_3^-$ | $C_2H_5$ | $CF_3$ | H | |
| II-8 | $CH_3$ | $(CH_2)_3SO_3^-$ | $C_2H_5$ | $C_2H_5$ | Cl | Cl | |
| II-9 | H | $C_2H_5$ | $(CH_2)_3SO_3^-$ | $CH_3$ | Cl | Cl | |
| II-10 | 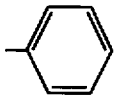 | $CH_2CF_3$ | $(CH_2)_2CH(SO_3^-)-CH_3$ | $C_2H_5$ | $CF_3$ | H | |
| II-11 | 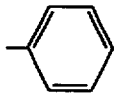 | $C_2H_5$ | $(CH_2)_3SO_3^-$ | $CH_2CH_2OH$ | Cl | Cl | |
| II-12 | 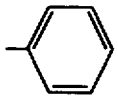 | $C_2H_5$ | $(CH_2)_3SO_3^-$ | $C_2H_5$ | $CF_3$ | Cl | |
| II-13 | 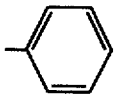 | $C_2H_5$ | $(CH_2)_3SO_3^-$ | $C_2H_5$ | $CF_3$ | CN | |
| II-14 | 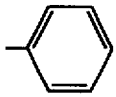 | $C_2H_5$ | $(CH_2)_4SO_2(NHCOCH_3)$ | $CH_3$ | Cl | Cl | |
| II-15 | 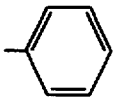 | $(CH_2)_4SO_3^-$ | $(CH_2)_4SO_3Na$ | $C_2H_5$ | CN | Cl | |

In the case of blue sensitization with compounds according to the formula (I), all the partial emulsions are adjusted to the same level of sensitivity to blue light. A decisive criterion in the selection of the blue sensitisers under consideration is that their absorption spectrum is as far as possible in the short wave range, preferably within the intrinsic sensitivity range of the silver halide emulsion, in order to ensure elevated selectivity on exposure. In the case of green sensitisation with compounds according to the formula (II), the quantities added are calculated in such a manner that a rising sensitivity series is achieved for the partial emulsions on exposure with green light, wherein one portion of the emulsion remains unsensitised or very low sensitized. The partial emulsions may be mixed together before casting or may also be applied onto the substrate in a sequence of separate layers.

The silver chloride-bromide emulsion preferably contains 30 to 70 mol.% of AgBr and 30 to 70 mol. % of AgCl.

The silver chloride-bromide emulsions are ripened with sulphur, preferably with gold/sulphur and in particular have an average grain diameter of 0.2 to 0.5 μm.

The substantial constituents of the photographic emulsion layers are binder and silver halide grains.

Details of suitable binders may be found in *Research Disclosure* 37254, part 2 (1995), page 286.

Details of suitable silver halide emulsions, the production, ripening and stabilisation thereof, may be found in *Research Disclosure* 37254, part 3 (1995), page 286 and in *Research Disclosure* 37038, part XV (1995), page 89.

Stabilisers may be used to suppress emulsion fog and to stabilise the image silver. Stabilisers may be associated directly with the emulsion layer or an adjacent layer: compounds of the classes with the following structure are suitable: triazoles; tetrazoles, imidazoles, oxazoles, thiadiazoles, benzotriazoles, mercaptotriazoles, mercaptotetrazoles, mercaptothiadiazoles, mercaptobenzoxazoles, mercaptobenzimidazoles, mercaptonaphthoxazoles, mercaptonaphthimidazoles, indolyl disulphides, tetraazaindenes, thioethers, mercaptopyrimidines. The stabilisers may contain solubilising substituents, such as for example sulpho groups, carboxyl groups or hydroxyl groups and the mercapto functional group may moreover be capped or untapped.

The layer structure may contain developer additives to activate development. Preferred substances are hydroquinones, sulphohydroquinones in conjunction with 1-phenyl-3-pyrazolidinone (phenidone), 1-phenyl-4-methyl-3-pyrazolidinone or 1-phenyl-4-methyl-4-hydroxymethyl-3-pyrazolidinone. Ascorbic acid or formaldehyde bisulphite are suitable anti-oxidants.

The photographic material may also contain UV light absorbing compounds, optical whiteners, spacers, formalin scavengers, light stabilisers, anti-oxidants, additives to improve the stability of whites, together with plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of photographic materials are hardened in the conventional manner, i.e. the binder used, preferably gelatine, is crosslinked by suitable chemical methods.

Suitable hardeners may be found in *Research Disclosure* 37254, part 9 (1995), page 294 and in *Research Disclosure* 37038, part XII (1995), page 86.

PRODUCTION OF A SILVER HALIDE EMULSION ACCORDING TO THE INVENTION

The following solutions were prepared:

Solution 1: 6000 g of demineralised water 180 g of gelatine 10 g of NaCl 14 ml of sulphuric acid (25 wt. %)

Solution 2: 1400 g of demineralised water 57 g of NaCl 112 g of KBr

Solution 3: 1400 g of demineralised water 320 g of $AgNO_3$

Solution 4: 1800 g of demineralised water 132 g of NaCl 238 g of KBr 0.4 mg of $K_2IrCl_6$ 0.076 mg of $RhCl_3$ Solution 5: 1800 g of demineralised water 680 g of $AgNO_3$ Solution 1 is introduced into a vessel and heated to 50° C. While maintaining a constant temperature, solutions 2 and 3 are simultaneously added to solution 1 within 18 minutes at a pAg value of 8. Solutions 4 and 5 are then simultaneously added within 30 minutes at 50° C while maintaining a pAg of 8. A silver chloride-bromide emulsion with 50 mol. % each of AgCl and AgBr and an average particle diameter of 0.31 μm is obtained. The emulsion is flocculated, washed and redispersed with a quantity of gelatine such that the gelatine/$AgNO_3$ weight ratio is 1.0. The emulsion is then optimally ripened at a pH of 4.5 with 3.5 μmol of gold chloride/mol of Ag and 1.5 μmol of thiosulphate/mol of Ag at 60° C. When chemical ripening is complete, the emulsion is stabilised with 20 mg of 5-hydroxy-7-methyl- 1,3,8-triazalndolizine/mol of Ag.

Test Criteria:

Sensitometric testing was performed to ISO standard method 6846, 1992. The following characteristics are stated in the present patent: minimum densities (Dmin), maximum densities (Dmax), photographic sensitivity (E) and copying range (R).

Photographic sensitivity was determined at a density of 0.6 above Dmin.

The copying range is derived from the formula R=(log Hs−log Ht). In this formula, Hs means the exposure required to produce a density of 0.9×(Dmax−Dmin), and Ht means the exposure required to produce a density of 0.04 above Dmin.

The copying range was determined for both hard and soft gradations, wherein a conventional commercial filter set was used for exposure. Hard gradation was determined with filter 5 (F5=blue light) and soft gradation with filter 0 (F0=green light). Exposure time was 10 seconds in each case.

Development was performed with Agfa-Neutol in a processing machine with a developer having a composition per litre of:

Potassium sulphite solution, D=1.45 375 ml

1 -phenyl-4-methyl-3 -pyrazolidinone 0.8 g

Phenidone 0.5 g

Hydroquinone 30.0 g

Potassium carbonate 219.0 g

Ethylenediaminetetraacetic acid, $Na_4$ salt 52.0 g

Potassium hydroxide solution, D=1.50 15 ml

The developer is diluted 1:7 with water for use.

EXAMPLE 1

The photographic layer structures were applied onto paper coated on both sides with polyethylene. Unless otherwise stated, the applied quantifies of the layer constituents are given in g/m$^2$. In the case of the silver halide emulsion, the applied quantity is stated as the $AgNO_3$ equivalent.

Example 1 relates only to the purely blue sensitised portion of the emulsion. The intention is to demonstrate selectivity for blue and green copying light according to filters F5 and F0 respectively. The green sensitivity of the blue sensitive portions of the emulsion should be as low as possible in order to achieve a large gradation range in conjunction with the green sensitised portions of the emulsion.

Layer 1

2.3 g of the AgBrCl emulsion described above, 3.5 g of gelatine, in each case 0.05 g/100 g of $AgNO_3$ of blue sensitisers BS-1, BS-2, BS-3 and 1-5.

Layer 2

1.5 g of gelatine, 0.5 g of hydroquinone, 0.008 g of phenidone, 0.025 g of benzotriazole, 0.035 g of formalin.

Photographic testing revealed the following result:

| Sample | | E at F0 | E at F5 | ΔE F5 − 50 | λmax nm |
|---|---|---|---|---|---|
| BS-1 | Comparison | 1.876 | 2.268 | 0.392 | 470 |
| I-5 | Invention | 1.679 | 2.226 | 0.547 | 440 |
| BS-2 | Comparison | 1.805 | 2.332 | 0.527 | 445 |
| BS-3 | Comparison | 1.568 | 2.105 | 0.537 | 450 |

As the results show, blue sensitiser 1-5 according to the invention is distinguished by elevated selectivity: relatively low green sensitivity is obtained at a relatively high blue sensitivity.

EXAMPLE 2

This example relates to a layer structure with variable gradation having partially green and blue sensitised portions of the emulsion.

Emulsion layer package (invention)

−1.20 g AgCl/Br+550 μmol I-5

–0.35 g AgCl/Br+500 μmol I-5+40 μmol II-4

–0.40 g AgCl/Br+400 μmol I-5+80 μmol II-4

–0.25 g AgCl/Br+200 μmol I-5+200 μmol II-4

The stated quantities of applied sensitiser are in each case per mol of Ag. Applied quantity of gelatine 3.5 g.

Protective layer package 2.0 g of gelatine, 0.5 g of hydroquinone, 0.008 g of phenidone, 0.025 g of benzotriazole, 0.05 g of formalin.

Emulsion layer package (comparison)

–1.10 g AgCl/Br+180 μmol BS-1

–0.50 g AgCl/Br+130 μmol BS-1+40 μmol II-4

–0.60 g AgCl/Br+80 μmol BS-1+100 μmol II-4

–0.20 g AgCl/Br+200 μmol II-4

The stated quantities of applied sensitiser are in each case per mol of Ag. Total applied quantity of gelatine 3.5 g.

Protective layer package 2.0 g of gelatine, 0.5 g of hydroquinone, 0.008 g of phenidone, 0.025 g of benzotriazole, 0.05 g of formalin.

Sensitometric testing is summarised in the following table. As may be seen, the layer structure according to the invention exhibits a considerably extended gradation range.

| Sample | Dmin | Dmax | E at F0 | E at F5 | R at F0 | R at F5 | ΔR F0/F5 |
|---|---|---|---|---|---|---|---|
| Invention | 0.075 | 2.25 | 2.48 | 2.28 | 1.56 | 0.52 | 1.04 |
| Comparison | 0.075 | 2.27 | 2.53 | 2.33 | 1.28 | 0.50 | 0.78 |

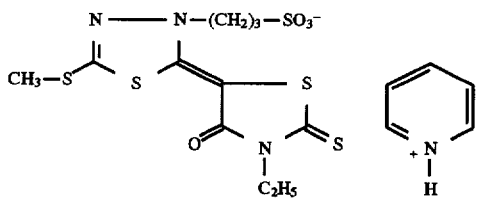

BS-1

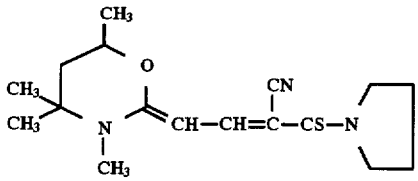

BS-2

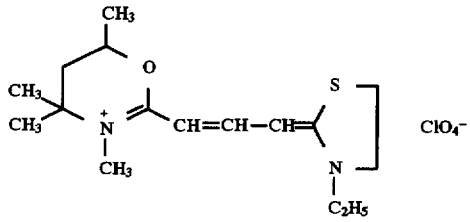

BS-3

We claim:

1. Black & white paper with variable gradation which comprises a silver chloride-bromide emulsion which is divided into at least three portions, one portion is sensitized with a blue sensitizer and two further portions are sensitized both with differing quantities of blue sensitizer and with differing quantities of a green sensitizer, wherein the blue sensitizer is of the formula (I) and the green sensitizer is of the formula (II)

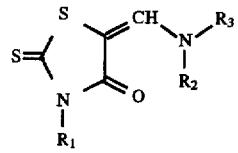

(I)

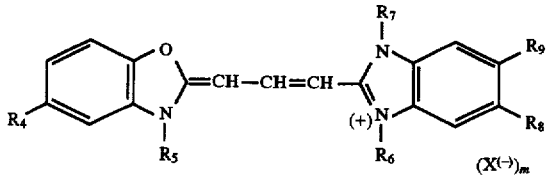

(II)

in which $R_1$ means alkyl, alkenyl, aryl or aralkyl, $R_2$ and $R_3$ mutually independently mean hydrogen, alkyl, alkenyl or aryl or together mean the remaining members of a 5 to 7 member ring which can further contain a further hetero atom, $R_4$ means hydrogen, halogen, alkyl, alkoxy or aryl, $R_5$ and $R_6$ mutually independently mean alkyl, carboxyalkyl or sulpho-alkyl, $R_7$ means alkyl, hydroxyalkyl or acyloxyalkyl, $R_8$ means halogen, CN or $CF_3$, $R_9$ means hydrogen, halogen or $CF_3$ $X^{(-)}$ means an anion and m means 0 or 1, wherein m means 0 if at least one of residues $R_5$ and $R_6$ means sulphoalkyl.

2. Black & white paper with variable gradation according to claim 1, wherein $R_1$means $C_1$–$C_6$ alkyl which is unsubstituted or substituted by carboxy, halogen, hydroxy or $C_1$–$C_4$ alkoxycarbonyl; $C_2$–$C_6$ alkenyl; phenyl or benzyl which are unsubstituted or substituted by halogen, $C_1$–$C_4$ alkyl or $C_1$–$C_4$ alkoxy, $R_2$ means hydrogen or $C_1$–$C_4$ alkyl, $R_3$ means $C_1$–$C_4$ alkyl which is unsubstituted or substituted by hydroxy, phenyl which is unsubstituted or substituted by halogen, $C_1$–$C_4$ alkyl or $C_{1-4}$ alkoxy; or $C_2$–$C_6$ alkenyl, $R_2$ and $R_3$ together with nitrogen atom form a saturated 5 to 7 membered ring, which can further contain a further hereto-atom, $R_4$ means hydrogen, halogen, $C_1$–$C_4$ alkyl or phenyl, $R_5$ and $R_6$ means $C_1$–$C_4$ alkyl residues which are unsubstituted or substituted by OH, $SO_3H$, COOH or $SO_2NHCO$-alkyl, where alkyl is a $C_1$–$C_4$ alkyl group, $R_7$ means $C_1$–$C_4$ alkyl which is unsubstituted or substituted by OH.

3. Black & white paper with variable gradation according to claim 1, wherein the silver chloride-bromide emulsion contains 30 to 70 mol. % of AgCl.

4. The black and white paper as claimed in claim 1 wherein $R_2$ and $R_3$ together with the nitrogen form a saturated 5 to 7 member ring which contains N, O or S.

* * * * *